United States Patent [19]

Matsushita et al.

[11] Patent Number: 4,771,821

[45] Date of Patent: Sep. 20, 1988

[54] METHOD FOR CONTROLLING EARLY CASTING STAGE IN CONTINUOUS CASTING PROCESS

[75] Inventors: Akira Matsushita; Masami Temma, both of Sakai; Wataru Ohashi, Tokyo, all of Japan

[73] Assignee: Nippon Steel Corporation, Tokyo, Japan

[21] Appl. No.: 899,483

[22] Filed: Aug. 22, 1986

[30] Foreign Application Priority Data

Sep. 2, 1985 [JP] Japan ..... 60-193430
Oct. 11, 1985 [JP] Japan ..... 60-226483
Oct. 14, 1985 [JP] Japan ..... 60-228273

[51] Int. Cl.[4] ..... B22D 11/16

[52] U.S. Cl. ..... 164/452; 164/453; 164/483

[58] Field of Search ..... 164/4.1, 449, 450, 452, 164/453, 483

[56] References Cited

FOREIGN PATENT DOCUMENTS 56-80369 7/1981 Japan .
56-165553 12/1981 Japan ..... 164/449
58-9757 1/1983 Japan ..... 164/453
58-84652 5/1983 Japan ..... 164/453

*Primary Examiner*—Nicholas P. Godici
*Assistant Examiner*—Richard K. Seidel
*Attorney, Agent, or Firm*—Kenyon & Kenyon

[57] ABSTRACT

A method for controlling an early stage casting in a continuous casting process comprising the steps of commencing to pour molten steel into a mold provided with a dummy bar head through an immersion nozzle provided with a flow rate control device, detecting that a steel level in the mold has reached a predetermined drawing commencement level and commencing drawing of the dummy bar head. A holding time for molten steel in the mold is predetermined, from the commencement of pouring molten steel into the mold to a commencement of the drawing of the dummy bar head, through a solidified shell formation velocity under prevailing operating conditions, and a prediction is made of whether or not, when the steel level has reached the predetermined level, a molten metal holding time substantially equal to the predetermined molten metal holding time can be obtained, and the flow rate of the molten steel is controlled in accordance with the result of the prediction.

3 Claims, 13 Drawing Sheets

METHOD FOR CONTROLLING EARLY CASTING STAGE IN CONTINUOUS CASTING PROCESS

BACKGROUND OF THE INVENTION

1. Field of the Invention

The present invention relates to a method for controlling an early casting stage, from the start of pouring molten steel to the start of drawing a dummy bar, in a continuous casting process.

2. Description of the Related Art

It is well known that a continuous casting process is carried out by holding molten steel supplied by a ladle or the like in a tundish and then pouring the molten steel into a mold from the tundish through an immersion nozzle. The immersion nozzle is usually provided with a flow rate controlling apparatus such as a sliding nozzle or the like.

Since the continuous casting mold is opened at the top and the bottom, the mold is first provided with the head of a dummy bar (hereafter referred to as dummy bar head) at the start of the casting process, the bottom of the mold is closed, and the molten steel is then poured into the mold. Cooling of the molten steel poured into the mold starts at the surface brought into contact with the mold wall, and accordingly, solidified shells are sequentially formed.

When the solidified shells reach a desired thickness, and at the same time the molten steel level in the mold reaches a predetermined level, a dummy bar is drawn. The time from the start of the pouring of the molten steel into a mold to the start of the drawing of the dummy bar is defined as the molten steel holding time in a mold (hereinafter referred to as the holding time).

A very short holding time will cause a breakout to occur, in which the solidified shells are broken by a drawing force of a strand due to an insufficient formation of the solidified shells, and thus the continuous casting process must be stopped. On the other hand, a very long holding time will cause seizing to occur between a solidified shell and the dummy bar head, and accordingly, separation of the two becomes difficult. Since damage generated during the very short holding time is remarkably larger than that generated during the very long holding time, conventional control at an early casting stage is carried out by determining the timing of the start of the drawing so as to ensure a necessary holding time, predetermined with reference to past experience, as a first condition.

As disclosed in Japanese Unexamined Patent Publication No. 58-84652 a continuous casting technique is proposed, wherein an amount of molten steel and the degrees of opening of the sliding nozzle corresponding thereto are calculated from moment to moment from the depth of the molten steel in a tundish, with reference to the molten steel bath level rising pattern (below bath rising patterns) in a mold in which the bath level rising pattern is predetermined by attaining a proper holding time, and control of an amount of molten steel poured is carried out in accordance with this calculation. In an actual operation, however, the flow velocity and flow rate of molten steel poured into a mold are easily changed by variations in the nozzle characteristics, and other problems that arise such as an incorrect depth, temperature, and composition of the molten metal in a tundish, or an unsatisfactory operation of the nozzle.

Thus, in the former process, the process control can not follow charges in the amount of molten steel poured and the drawing process is often started in a state such that the molten steel level is not within a suitable range, as explained below. Further, in the latter process, since the moment-to-moment molten steel level is not compared with the predetermined bath level rising pattern, the molten steel is poured as it is even if the flow velocity of the poured molten steel does not correspond to the predetermined velocity. Therefore, the proper holding time cannot be attained, or the drawing process is commenced after the holding time is finished.

The above-mentioned conventional process comprises a step of controlling the pouring of the molten steel without considering an actual flow velocity thereof, namely, controlling the rising speed of the bath level in the mold. Thus, it is difficult to maintain a constant holding time because of various malfunctions in the process. Consequently, a breakout will occur and a shift to bath level control in a usual operation, cannot be smoothly carried out.

SUMMARY OF THE INVENTION

An object of the present invention is to provide a method for controlling an early casting stage in a continuous casting process so that above-mentioned conventional problems can be fundamentally solved.

According to a present invention, in a first stage of a continuous casting process comprising the steps of;

(a) commencing the pouring molten steel into a mold provided with a dummy bar head through an immersion nozzle provided with a flow rate control device and determining a holding time for holding the molten steel in the mold, through a solidified shell formation time in the mold under the prevailing operating conditions before commencing the drawing of the dummy bar head and (b) when it is detected that the steel level in the mold has reached a predetermined drawing commencement level, commencing the drawing of the dummy bar head, a method is provided for controlling a first stage casting in a continuous casting process comprising the steps of;

(c) setting a standard steel bath level rising pattern wherein, when the holding time for the molten steel in the mold has passed, and at substantially the same time the steel level reaches the drawing commencement level, (d) predetermining at least one intermediate confirmation level lower than the drawing commencement level, (e) commencing the pouring of the molten steel, (f) measuring the time elapsed from the commencement of pouring and measuring the steel bath level at least the intermediate confirmation level, (g) carrying out a flow rate control in accordance with the standard steel both level rising pattern until the steel level reaches the predetermined intermediate confirmation level and calculating any deviation by comparing the actual time required with a time required in accordance with the standard steel bath level rising pattern, (h) carrying out a flow rate control of the molten steel with reference to a steel bath level rising pattern corrected so that the deviations are corrected before the commencement of drawing and commencing drawing the dummy bar head after attaining a proper holding time for the molten steel.

BRIEF DESCRIPTION OF THE DRAWINGS

FIGS. 3A and 3B are diagrams showing an example in which an actual bath level rising speed or velocity has deviated from the standard bath level rising pattern X, in which FIG. 3A is an example of a bath level rising velocity larger than the fundamental bath level rising pattern X, and FIG. 3B is an example of a bath level rising velocity smaller than pattern X;

FIGS. 5A and 5B are flow charts explaining a concrete means of correcting the deviation, in which FIG. 5A is a flow chart of a feed back control process, and FIG. 5B is a flow chart of a control process by which deviation of a degree of opening of a nozzle is corrected;

FIGS. 11A and 11B are graphs explaining another example of a state of control of the early casting stage according to the present invention, in which FIG. 11A shows changes of the bath level, and FIG. 11B shows a degree of opening of a sliding nozzle 6;

FIGS. 12A and 12B are graphs explaining another example of a state of control of the early casting stage according to the present invention, in which FIG. 12A shows changes of the bath level, and FIG. 12B shows a degree of opening of a sliding nozzle 6.

DESCRIPTION OF THE PREFERRED EMBODIMENTS

Figure 1:
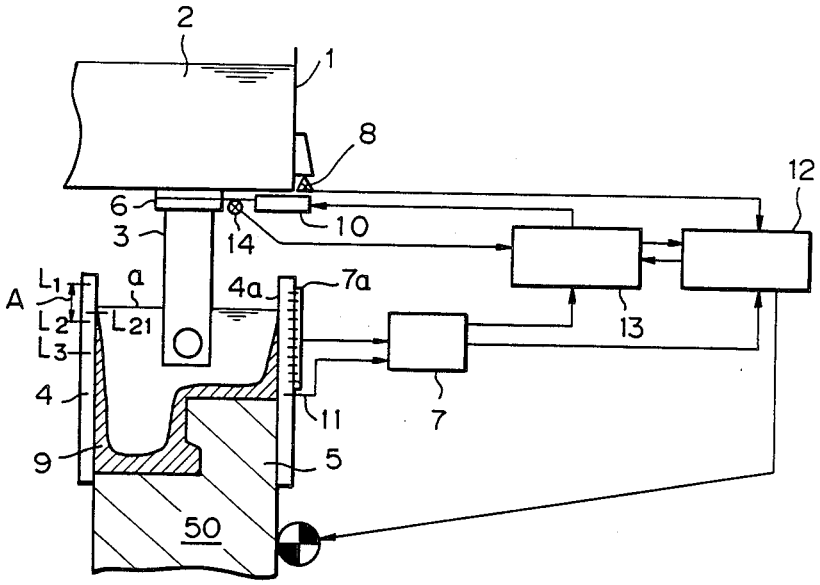
FIG. 1 shows an example of an apparatus explaining a fundamental feature of the present invention, in which a view is given of a structure of a mold and the portion adjacent thereto in a well known continuous casting installation.

FIG. 1 shows an example of an apparatus explaining a fundamental feature of the present invention, i.e., a view of a structure of a mold and the portion adjacent thereto in a well known continuous casting installation;

In FIG. 1, 1 denotes a tundish storing molten steel 2, 3 an immersion nozzle, and 4 a mold. The mold 4 is provided with a dummy bar head 5. The immersion nozzle 3 is provided at the bottom of the tundish 1 through a sliding nozzle 6. The flow rate of molten steel 2 poured into the mold 4 can be controlled by adjusting degree of opening of the sliding nozzle 6. The mold 4 is provided with a bath level detecting device 7. The bath level detecting device 7 shown in FIG. 1 has thermosensitive elements *7a* buried for a suitable depth in the bath with regard to the casting direction, but preferably, a well known level meter or the like, using radiation or magnetic lines of force, is used in the present invention. Further, the tundish 1 is provided with a weight detecting apparatus 8 for detecting the depth of any remaining molten steel 2.

The temperature of the molten steel 2 adjacent to the immersion nozzle 3 when starting the pouring of the molten steel 2 into the mold 4 from the tundish 1 is low, and therefore, the degree of opening of the sliding nozzle 6 is preferably made as large as possible to prevent the molten steel 2 from clogging the sliding nozzle 6. If, however, this degree of opening is maintained, the flow rate will be too high and the steel bath level, i.e., the molten steel bath level rising, will rise too rapidly. Therefore, when a certain time has elapsed from the start of the pouring of the molten steel 2 and the possibility of clogging in the sliding nozzle has decreased the degree of opening of the sliding nozzle 6 must be reduced.

On the other hand, when the molten steel 2 is poured into the mold 4 the portion of the molten steel 2 brought into contact with the wall surface 4*a* of the mold 4 is solidified, so that a solidified shell 9 is formed. The speed of formation of the solidified shell 9 is changed by a size and grade of a strand produced, the shape of the dummy bar head or the material of the mold 4, or by an operating condition such as a cooling condition. Further, the thickness of the solidified shell 9, which will not be broken by a drawing force generated when a drawing of a dummy bar 50 is commenced is also changed by operating conditions.

Therefore, a holding time for forming a solidified shell thickness sufficient to resist the drawing force can be determined from the solidified shell formation speed under the operation conditions by investigating and predetermining the solidified shell formation speed and solidified shell thickness resistant to the drawing force under various operating conditions. When the pouring of the molten steel 2 is continued in a state wherein a dummy bar head 5 is stoppered a steel level a in the mold 4 gradually rises. In a usual operation, a level control controlling a casting speed or flow rate of the molten steel 2 is carried out in such a manner that the steel level a is always at a desired level within a control region A having an upper limit $L_1$ and a lower limit $L_2$. The bath level detecting device 7 detects the upper steel level a, in an area from the control region A to a predetermined position $L_3$ below the control region A.

Thus, when the pouring of the molten steel 2 is commenced, and the level thereof has reached the control region A, the drawing of the dummy bar is started. After the signal for starting the drawing is received. The bath level rising speed control is then changed to above-mentioned level control. As explained above, the level of the steel bath at the start of the drawing is set to an optional level in the control region A. The steel bath level detecting device 7 is operated in such a manner that a bath level within at least the region of $L_1$ to $L_2$ is detected.

The bath level rising speed in the mold 4 is determined by the quantity of molten steel 2 poured per unit of time, and by the cross-sectional area of the mold 4, and this speed can be set by casting conditions such as the standard size, the depth of the molten steel 2 in the tundish 1, and the temperature and composition of the molten steel 2.

Therefore, when a holding time has been determined, a standard bath level rising pattern necessary to enable the steel level a to reach the above-mentioned starting level at the same time as the holding time, can be set by the casting condition.

Figure 2:
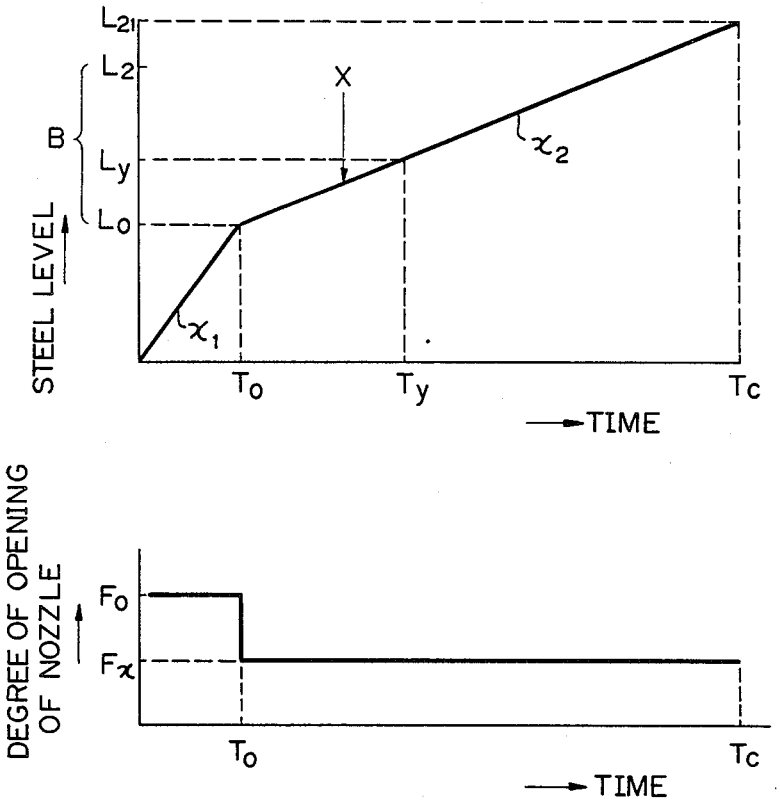
FIG. 2 is a diagram showing an example of a standard bath level rising pattern.

FIG. 2 shows an example of the basic standard level rising pattern and a degree of opening of the sliding nozzle 6 corresponding thereto. In FIG. 2, the time elapsed from the start of the pouring of the molten steel 2 is shown by the abscissa axis and the bath surface level and the degree of the opening of the sliding nozzle 6 is shown by the ordinate axis.

The holding time is determined by $T_c$. The level of the bath at the commencement of the drawing is set to $L_{21}$ in the control region A. The bath level rising pattern at the state where the degree of opening of the sliding nozzle 6 is large, to prevent clogging at the start of the pouring as mentioned above, (hereinafter referred to as the early state) is determined as $X_1$ from the preset a degree of opening of the sliding nozzle 6 and the above-mentioned casting condition in the early state. The degree of opening of the sliding nozzle 6 at the early state is hereinafter referred to as the first opening degree. When the possibility of nozzle clogging in the early state has vanished, and the early state is changed to an usual control state of the bath level rising speed, preferably the degree of opening of the sliding nozzle 6 is reduced to be within a region in which clogging of the molten steel 2 will not be generated and a stable bath level rising velocity is ensured.

Therefore, a standard bath level rising pattern X can be set by a bath level rising pattern $X_1$ at the state in which the first opening degree of the sliding nozzle 6 and a bath level rising pattern $X_2$ in which a bath level reaches a level $L_{21}$ at $T_c$ while ensuring a stable bath level rising velocity after the change to the usual state.

In FIG. 2, $T_o$ is a time at which the first degree of opening the nozzle 6 is changed to the degree of opening thereof in the usual state, and $L_o$ is a bath level. When a bath level rising pattern X is set, the degree of opening of the sliding nozzle 6 is controlled to obtain a bath level rising velocity equal to the basic bath level rising pattern. In FIG. 1, 12 is a control unit in which a standard bath level rising pattern X is set from the above-mentioned various conditions, and the operation hereinafter explained are then carried out. 13 is a flow rate control unit in which a setting command for the degree of opening of the sliding nozzle 6 is carried out according to the progress of the operation. Thus, a driving unit 10 of the sliding nozzle 6 is driven by the setting command for the degree of opening from the operating control unit 12 and the degree of the opening of the sliding nozzle 6 is determined and controlled to be $F_o$ and $F_x$.

The start of the pouring molten steel 2 may be detected by using an opening degree detector 14 to detect a state where the sliding nozzle 6 is opened, by detecting the rising of a stopper (not shown) in a device provided with a stopper for opening or closing, and by providing a level detector 11 at a level immediately above the dummy bar head 5 of the mold 4 and detecting a time when an arrival of the molten steel is confirmed as the start of the pouring.

According to the experience of the present inventor, even though the sliding nozzle 6 is opened, the molten steel 2 does not immediately start flowing therethrough. Thus, the use of a means for detecting, by the level detector 11, that the molten steel 2 had actually reached a predetermined level in a mold efficiently enhanced subsequent control accuracy.

The bath level rising velocity in a practical operation is often varied by external factors, and the actual bath level rising pattern often deviates from the predetermined basic bath level rising pattern X. According to the present invention, the actual bath level rising velocity corresponding to the standard bath level rising pattern X is obtained at a time when a steel level a reaches an intermediate portion of a mold, i.e., the starting level for drawing, and when a deviation occurs, the acutal bath level rising pattern is adjusted.

Figure 3A:
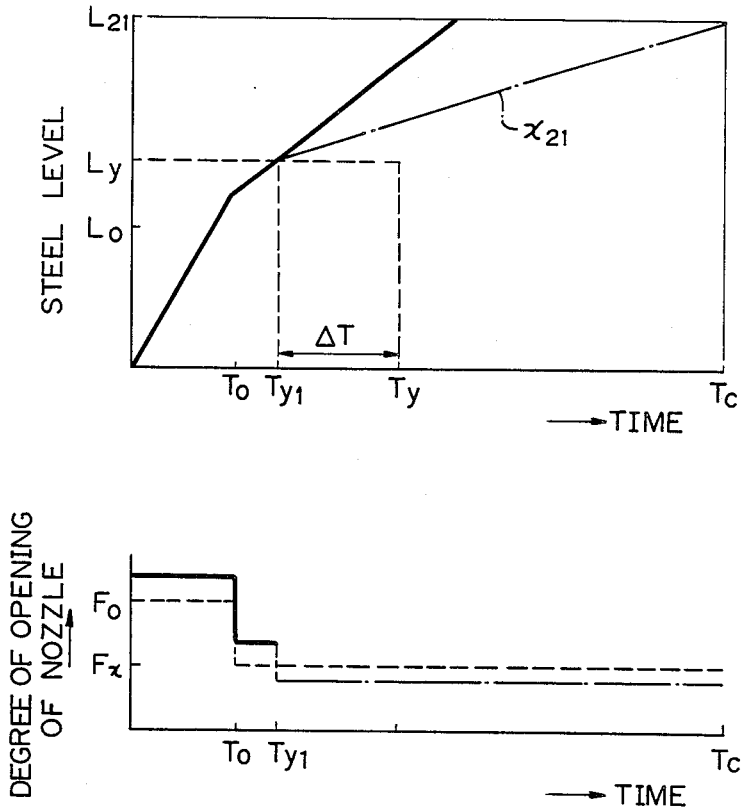
Figure 3B:
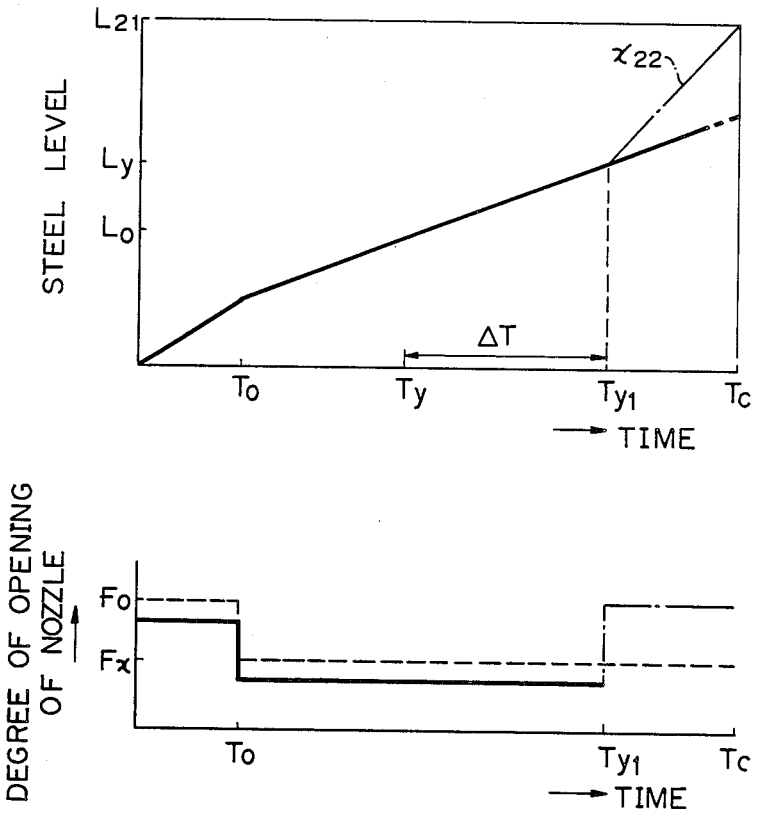

FIGS. 3A and 3B are diagrams showing an example in which the actual bath level rising velocity has deviated from the standard bath level rising pattern X. In particular, FIG. 3A is a diagram of an example of a bath level rising velocity higher than the standard bath level rising pattern X, and FIG. 3B is a diagram of an example of a bath level rising velocity lower than the standard both level rising pattern X.

In the present invention, the bath surface level detector 7 is provided with a function for detecting a predetermined steel level $L_y$ between a steel level $L_o$ and a level $L_{21}$ at a start of the drawing. The level $L_y$ is referred to hereinafter as an intermediate confirmation level or a confirmation level.

In the example of FIG. 3A, a time when the bath surface reaches the confirmation level $L_y$ is $T_{y1}$, which is shorter by $\Delta T$ than the $T_y$ necessary for reaching a level $L_y$. Consequently, when the pouring of the molten steel 2 is continued, according to the predetermined basic bath level rising pattern, the steel level reaches the level $L_{21}$ for the start of the drawing before the holding time $T_c$. Therefore, in the present invention, a required time $T_{y1}$ from the start of the actual pouring of the molten steel 2 to the reaching of the confirmation level $L_y$ is detected, and this required time $T_{y1}$ is compared to the required time $T_y$ for the basic bath level rising pattern, to detect any deviations. When there are no deviations, a flow rate control is carried out according the standard bath level rising pattern, when $T_y$ is larger than $T_{y1}$ ($T_y > T_{y1}$) as shown in FIG. 3A, the subsequent bath level rising velocity is made lower than that of the standard bath level rising pattern and the bath level rising pattern is adjusted to $X_{21}$, shown by a dotted line, so that the bath surface reaches the level $L_{21}$ at the start of drawing. Thus, by adjusting the degree of opening of the sliding nozzle 6 in accordance with the adjusted bath level rising pattern $X_{21}$, the above-mentioned deviation can be corrected before the start of the drawing of a dummy bar.

On the other hand, when $T_y$ is smaller than $T_{y1}$ ($T_y < T_{y1}$), as shown in FIG. 3B, the subsequent bath level rising velocity is adjusted to a bath level rising pattern $X_{22}$, which has a higher velocity than the standard bath level rising pattern, and thus the flow rate of the molten steel 2 is regulated so that the steel level reaches the starting level $L_{21}$ for the drawing at substantially the same time as, and not over, the holding time. As a concrete means of eliminating deviations in accordance with the corrected bath level rising pattern $X_{21}$ or $X_{22}$, a feed back control means wherein, when a corrected bath level rising pattern is set, the following time elapsing and the corresponding steel level a are moment-to-moment detected and the degree of opening of the sliding nozzle 6 is immediately controlled when a deviation from the corrected bath level rising pattern occurs, or a means wherein, while the corrected bath level rising pattern is set, deviation of an actual degree of opening from the set degree of opening of the sliding nozzle 6 is obtained and the actual opening degree is corrected to the nozzle opening degree corresponding to the corrected bath level rising pattern.

Figure 5A:
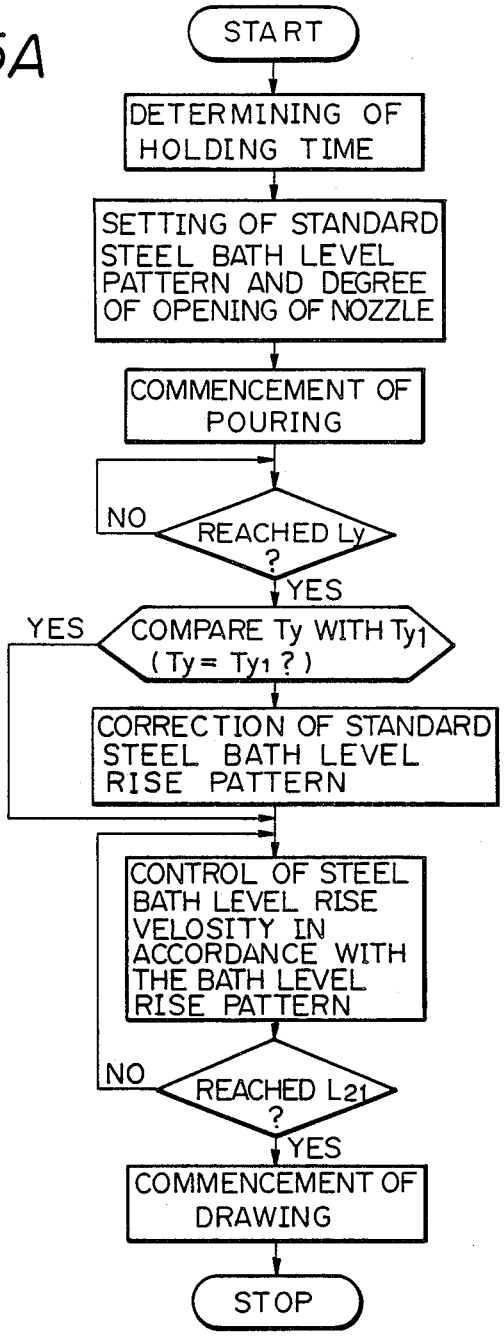
Figure 5B:
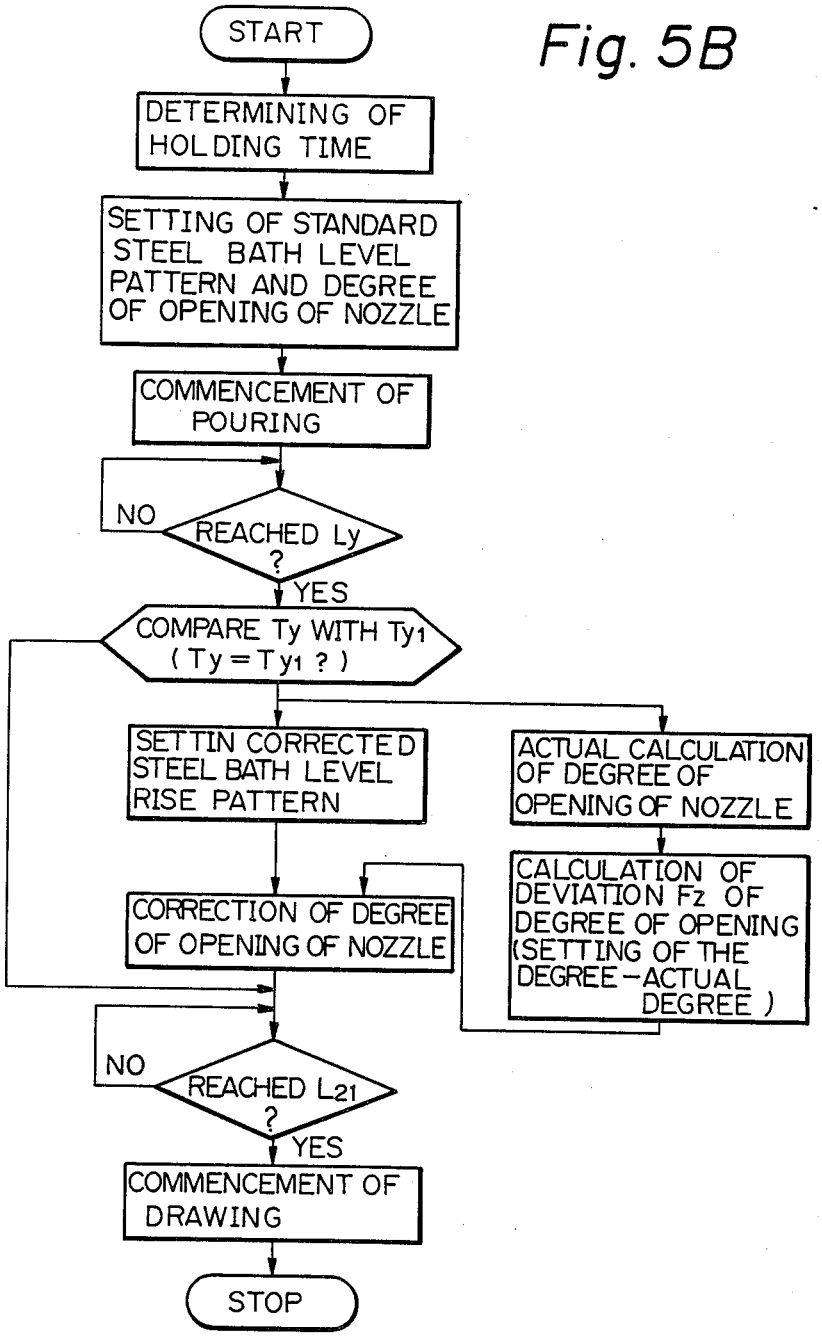

FIGS. 5A and 5B are flow charts of the control process, in which FIG. 5A is a flow chart of a feed back control process in the conventional device, and FIG. 5B is a flow chart of the process for correcting deviation of nozzle opening according to the present invention.

Prior to the start of the casting, the holding time is calculated and a standard bath level rising pattern and a corresponding nozzle opening degree are set, and then the pouring of the molten steel is commenced. When the steel level a reaches an intermediate confirmation level $L_y$, the required times $T_{y1}$ and $T_y$ are compared. When a deviation of the actual bath level rising pattern from the standard bath level rising pattern has occurred, the standard bath level rising pattern is adjusted and a corrected bath level rising pattern is set. In the flow chart of FIG. 5A, when a corrected bath rising pattern is set, the degree of opening of the sliding nozzle 6 is adjusted so that the bath level rising velocity is in accordance with the bath level rising pattern. Then the time elapsing and the steel level a are detected moment-to-moment, and when a deviation from the bath level rising pattern has occurred, a signal for adjusting the opening degree of the sliding nozzle 6 is output so that the bath level rising velocity is controlled, and when the steel level a reaches level $L_{21}$ for drawing commencement, the drawing is commenced.

In this example, it is necessary that a steel level higher than the confirmation level $L_y$ be detected by a steel level detecting device 7. Thus, the control of the bath level rising velocity becomes complicated. Nevertheless, the above-mentioned control means has a superior controllability, so that it rapidly and exactly responds to the above explained deviations.

On the other hand, in the example of FIG. 5B the corrected bath level rising pattern is set, and at the same time, the actual nozzle opening degree is calculated from the bath level rising velocity so that a deviation between a set nozzle opening degree and an actual nozzle opening degree is corrected. By setting a nozzle opening degree while adding the deviation to a basic opening degree set from the corrected bath level rising pattern, a bath level rising velocity accurately corresponding to the corrected bath level rising pattern can be obtained. The control operation of this example is simple, and as explained later, the deviation can be efficiently removed before the steel level a reaches a level for the commencement of drawing, by setting a plurality of confirmation levels $L_y$.

Figure 4A:
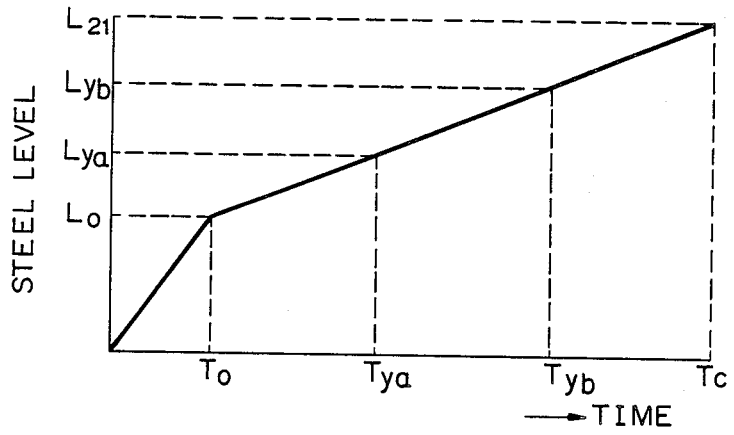
FIG. 4 is a diagram showing another example in which the actual bath level rising velocity has deviated from the pattern X.
Figure 4B:
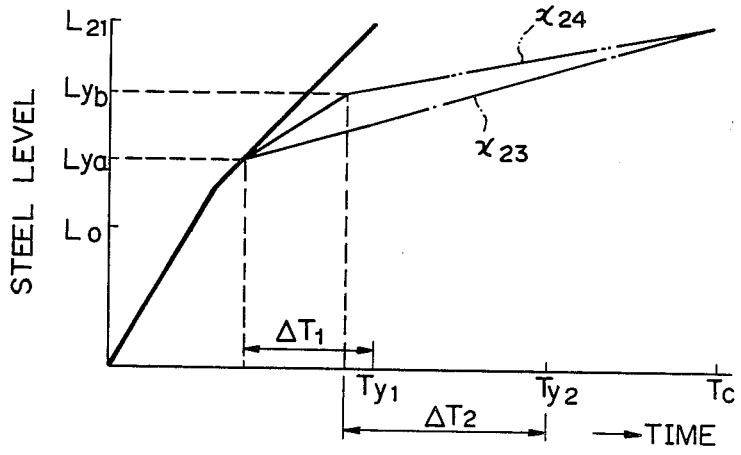

The confirmation level $L_y$ should be set in a region having a surplus by which above mentioned deviations can be corrected by calculating the deviations except for the time until the steel level reaches a level $L_o$ of the state of the early stage, which state is inevitably generated directly after the commencement of the pouring, and correcting the bath level rising pattern by correcting the opening degree of the nozzle 6 to that between a fully open degree and a minimum opening degree at which the nozzle will not become clogged. Namely, as shown in FIG. 2, the confirmation level $L_y$ may be set to an optional level in a region B positioned between $L_o$ and $L_2$ in which region deviations are eliminated. The confirmation level $L_y$ is not restricted to only one point, but for example, as shown in FIG. 4, is can be set to two points ($L_{ya}$, $L_{yb}$) or more within a range of an intermediate portion B. As shown in FIG. 4B, the actual required times $T_{y1}$ and $T_{y2}$ are compared to the required time $T_{ya}$ and $T_{yb}$ according to the standard bath level rising pattern, and the deviation therebetween is obtained, the bath level rising patterns are corrected one after another so that the flow rate of the molten steel 2 can be controlled. Thus, particularly in a means for correcting the deviation of the nozzle opening degree, an accurate control can be carried out.

In FIG. 4B, $X_{23}$ is a first corrective pattern and $X_{24}$ is a second corrective pattern. Therefore, according to the present invention, a suitable control of the flow rate of the molten steel 2 can be rapidly carried out to combat various deviations under usual operational conditions. Thus, a predetermined holding time is attained and drawing of the steel can be commenced at a suitable steel level so that breakouts are prevented and a stabilized operation can be realized by a smooth shift to a level control.

However, the flowability of molten steel deteriorates due to for example, an extraordinary drop in the molten steel temperature or a preheating defect at the tundish 1 or immersion nozzle 3, and $T_{y1}$ becomes longer than shown in FIG. 3B in acutal operation. Consequently, the present inventor found that a state occurs wherein a bath level rising pattern can not be made to follow the basic bath level rising pattern only by correcting the bath level rising pattern.

Figure 6:
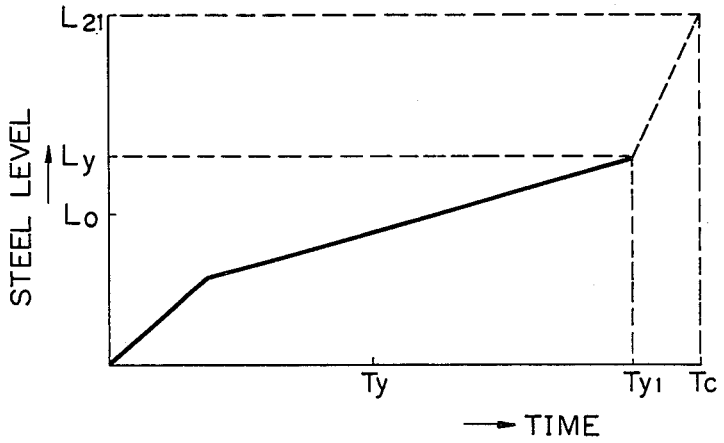
FIG. 6 is a diagram showing an example in which the bath level rising velocity is smaller than that in FIG. 2.

FIG. 6 shows an example of the above-mentioned case, wherein the bath surface has reached a confirmation level $L_y$ in a state whereby only a short time remains of a desired holding time $T_c$. When correction of the bath level rising pattern is commenced in the case of FIG. 6, the subsequent bath level rising velocity must be remarkably increased. Thus, even though the sliding nozzle 6 is fully opened, a situation occurs wherein control can not be performed because it is impossible to follow, with the result that holding time $T_c$ must be maintained for a longer time than necessary. Thus, the solidified shell is fused to the dummy bar head and a separation of the two becomes difficult. Further, since the bath level rising velocity just before changing to the level control of the usual operation is remarkably increased. Accordingly, a situation occurs wherein a change to the level control can not be smoothly performed due to the effect of the high velocity, and a stable operation can not be realized. This situation incurs little damage compared to the occurrence of a breakout, but in an acutal operation, it is a serious problem which can not be ignored.

Figure 7:
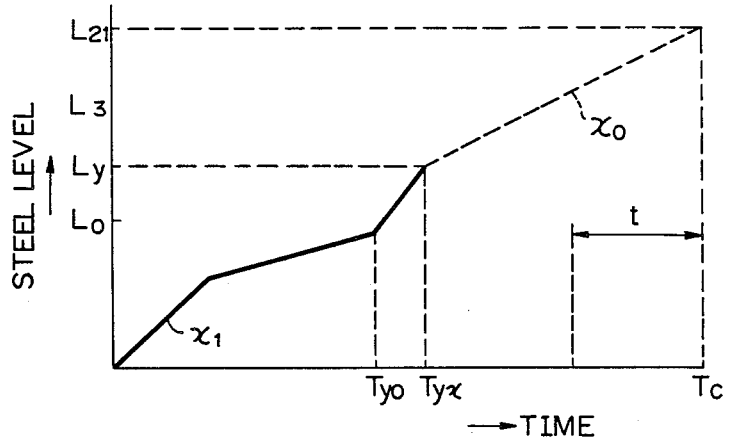
FIG. 7 is a diagram explaining a state of control according to the present invention.

The present invention provides a method for controlling an early casting stage wherein the above mentioned situation can be effectively countered and stabilized operation can be continuously carried out. FIG. 7 is a diagram illustrating a control of the situation according to the present invention.

In the present invention, first the confirmation level $L_y$ and the desired time $T_{yo}$ to reach the confirmation level $L_y$ hereinafter explained is previously set as follows in accordance with the above-mentioned operating conditions and casting conditions. That is, an example using a sliding nozzle 6 as a flow rate control device will be explained, whereby a maximum flow rate per unit time can be determined by a maximum degree of opening of the sliding nozzle 6 and a molten steel bath depth in the tundish 1 can be determined. When a steel bath level rising velocity is too high, the change to the level control cannot be performed and thus problems such as an overflow of the molten steel 2 arise. Thus, from the capacity of the sliding nozzle 6 and the limit of the maximum velocity of bath level rising speed in a range wherein operation can be stably performed, the bath level rising pattern is corrected. To enable the steel level a to reach $L_{21}$ at a time when the holding time $T_c$ has passed, the minimum time t can be determined by the operation condition and the casting condition. Therefore, if the confirmation level $L_y$ is determined at a suitable position between the steel bath level $L_o$ and the starting level $L_{21}$ of the drawing, and in a region wherein the necessary time t can be ensured, a required time $T_{yo}$ needed for the steel level a to reach the confirmation level $L_y$ from the standard bath level rising pattern X in accordance with the operating condition and the casting condition, can be set. The required time $T_{yo}$ may be set not only by using values set from the standard bath level rising pattern X as mentioned above, i.e., the value corresponding to $T_y$ in FIGS. 2 and 6, but also by using the values set from the standard bath level rising pattern X plus a very short surplus time obtained by measuring errors and considering control responsibilities.

In the present invention, when a situation occurs wherein the steel level a has not reached the confirmation level $L_y$, even though the required time $T_{yo}$ has passed since the confirmation of the start of the pouring of the molten steel, the actual bath level rising pattern is followed by the standard bath level rising pattern by increasing the degree of opening of the flow rate control device of the sliding nozzle to a emergency treatment opening degree, judging the passage of the required time $T_{yo}$ as a trigger. The emergency treatment opening degree may be set by operating and casting conditions such as a depth of the molten steel in the tundish and a strand size, etc., in a region where instability occurs at the sliding nozzle 6. In an example of FIG. 7, the required $T_{yo}$ is set so that it becomes equal to a value set by the standard bath level rising pattern. When the required time $T_{yo}$ has passed, the steel level a is lower than the confirmation level $L_y$. Thus, the sliding nozzle 6 is opened to the emergency treatment opening degree to maintain the present state until the steel level a reaches the confirmation level $L_y$. Since the required time $T_{yx}$ when the steel level a has reached the confirmation level $L_y$ was a time fully remaining the required time t ($T_c$-$T_{yx}$>t) the actual bath level rising pattern is corrected to a bath level rising pattern $X_0$ in which the steel level a reaches a starting level $L_{21}$ for drawing at the same time as the predetermined holding time $T_c$, and the flow rate of the molten steel is controlled so that the actual bath level rising pattern follows the standard bath level rising pattern.

The operating indication, which causes the sliding nozzle 6 to open to an emergency treatment opening degree when the state wherein the steel level a has not reached the confirmation level $L_y$ is confirmed, in spite of the passage of the predetermined required time $T_{yo}$, may be output at the time when the predetermined required time $T_{yo}$ has passed or at a later time by a required time longer than the required time $T_{yo}$. In the present invention, the sliding nozzle is opened to an emergency treatment opening degree by using the passage of the required time as a trigger.

According to the present invention, even though remarkable changes in the bath level rising velocity occur, which is unexpected in usual operation, the corresponding suitable flow rate control of molten steel can be immediately carried out. Thus, a required steel level can be realized within a predetermined holding time, adhesion of the dummy bar head to a solidified shell can be prevented, and a stabilized operation can be realized by a smooth change to the level control.

Just after the pouring of the molten steel has commenced, the molten steel temperature adjacent to the nozzle, as mentioned above, has become low and the nozzle or sliding nozzle is likely to be blocked by a lack of preheating of the tundish or the nozzle. In such cases, when a certain time has passed after the commencement of the pouring, metal adhered to nozzle is remelted so that the nozzle can be unblocked. These above phenomena remarkably increase the bath level rising velocity and the actual bath level rising pattern can not be made to follow the standard bath level rising pattern X by only a correction of above-mentioned bath level rising pattern. The above phenomena also occur after the steel level a has reached the confirmation level $L_y$. Thus, a situation occurs wherein the steel level can not be controlled by the above-mentioned process, so that a required holding time can not be realized. Further, the same phenomena can be caused by the occurrence of a change between the actual degree of opening of the sliding nozzle and the opening degree indicated by the control means, so that the flow rate of molten steel becomes higher than a predetermined flow rate since just after the commencement of the pouring.

The present invention also provides a control process in an early stage of casting wherein such a case can be efficiently dealt with and a stabilized operation can be continuously carried out without generating a breakout.

Figure 8A:
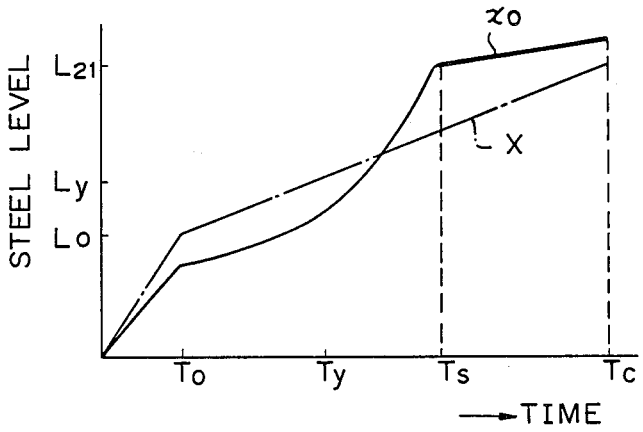
FIG. 8 is a diagram showing an example in which the bath level rising velocity is rapidly increased in an early casting stage.
Figure 8B:
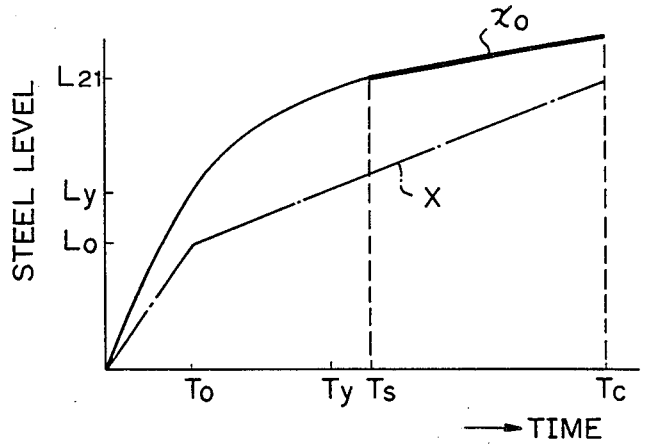

FIGS. 8A and 8B show an example in which the bath level rising velocity was increased more than the standard bath level rising pattern in a case of the early casting stage. In particular, FIG. 8A shows an example in which, after the steel level a has passed the confirmation level $L_y$, the bath level rising velocity was increased more than the standard bath level rising pattern. FIG. 8B shows an example in which the bath level rising velocity has been remarkably increased in the early stage just after the commencement of the pouring and although the actual bath level rising pattern was corrected. When the steel level reached the confirmation level $L_y$, the actual bath level rising velocity was increased by an effect of the high velocity in the early stage.

In such cases, long before reaching the holding time $T_c$, the steel level a reaches level $L_{21}$ for the start of the drawing. Namely, a required time $T_s$ for the steel level a to reach the drawing start level $L_{21}$ from the actual commencement of the pouring of the molten steel 2 becomes shorter than the holding time $T_c$, resulting in a breakout by starting the drawing while there is an insufficient formation of the solidified shell 9. Further, if the holding time $T_c$ is going to be ensured in the unsolidified state an overflow of the molten steel 2 from the mold 4 may be generated. However, in the present invention an opening degree of the flow rate control device in which the outflow of the molten steel 2 at a minimum flow rate can be carried out without generating nozzle clogging, by using the control properties of flow rate control device and the operating conditions, is previously obtained and the degree of opening of the nozzle 6, was set at an emergency treatment opening degree. This emergency treatment opening degree may be set by logical calculations and from past experience in accordance with the control properties determined by structure of the flow rate control device, such as the sliding nozzle 6 or stopper or strand size during the operation, steel grade, molten steel depth in the tundish, and molten steel temperature, etc.

When the pouring of the molten steel 2 is actually commenced, the required time $T_s$ is detected moment-to-moment, and at the same time, the steel level a is detected. When the steel level a has reached the drawing starting level $L_{21}$, the required time $T_s$ is compared to the holding time $T_c$. If $T_c$ is larger than $T_s$ ($T_s < T_c$), an emergency treatment opening degree indication is immediately given to the flow rate control device, the opening degree in the flow rate control device is decreased so that the bath level rising velocity is reduced. The bold line $X_0$ in FIG. 8 shows the control state. An emergency treatment opening degree is maintained until the holding time is reached and then drawing is commenced.

By carrying out this operation, a required solidified shell 9 can be formed in the mold 4 and a continuous stabilized operation can be carried out without generating problems such as breakout or an overflow of the molten steel 2 from the mold 4, etc.

According to the present invention, even if a remarkable change in the bath level rising velocity occurs, which can not be predicted in usual operation, the corresponding suitable control can be reliably carried out. Thus, a necessary holding time can be ensured, while an overflow of the molten steel 2 can be prevented and a breakout also can be prevented, so that a stabilized operation can be prevented, by a smooth change to a level control.

EXAMPLE 1

In a curved type continuous casting installation having a production capacity of 160 thousand ton per month, the present invention was applied to produce a low carbon aluminumkilled steel. The operating conditions and casting conditions of the present invention are shown in Table 1.

TABLE 1

Figure 9A:
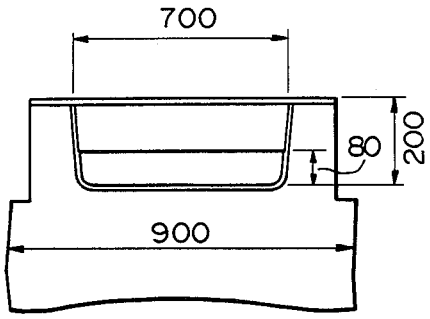
FIGS. 9A and 9B are a front view and a cross-sectional side view of a shape of a dummy bar head used in the example of FIGS. 5A and 5B.
Figure 9B:
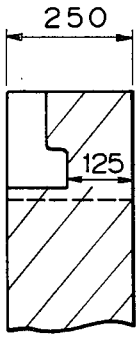

| | | | |
|---|---|---|---|
| Operating conditions | Strand size | | Width 1000 mm × Thickness 250 mm |
| | Steel grade | | Low carbon aluminumkilled steel |
| | Shape of dummy bar head | | Shape shown in FIG. 9 |
| | Mold | Size | Length 900 mm<br>Plate thickness 60 mm |
| | | Material | Copper |
| | | Cooling conditions | Long side: 3000 l/mm<br>Short side; 600 l/mm |
| Casting | Strand size | | The same as the above |
| | Molten steel depth in tundish | | 0.5–1.4 m |
| | Molten steel temperature | | 1550° C. ± 10° C. |

The holding time determined by a solidified shell formation velocity under the operating conditions given in Table 1 was 40 to 50 seconds. Thus, in example 1, the holding time $T_c$ was set to 50 seconds and the drawing starting level $L_{21}$ was 150 mm from the top end of the mold. The confirmation level $L_y$ was set to a level 300 mm from the top end of the mold, considering the above-mentioned settings.

Figure 10A:
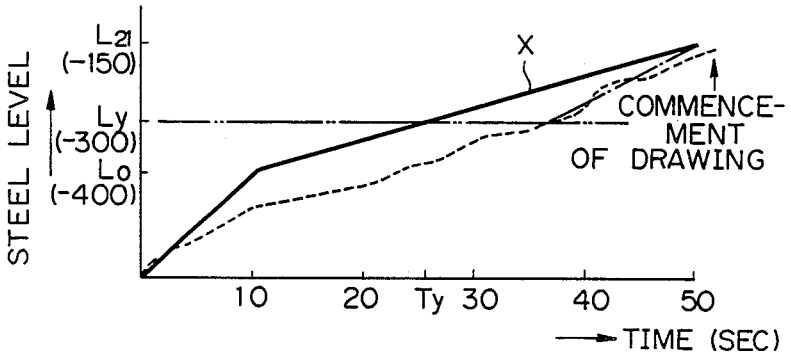
FIG. 10 is a diagram explaining an example of a state of control of an early casting stage according to the present invention.
Figure 10B:
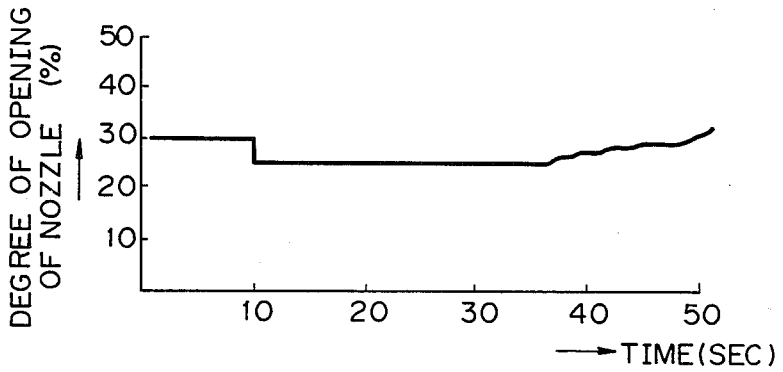

FIGS. 10A to 10B are diagrams illustrating control states of the example. The degree of opening of a sliding nozzle 6 at the early stage is made 30%, from past experience, whereby an $L_o$ of 400 mm from the upper end of the mold is obtained, and a standard bath level rising pattern X was set as shown by a solid line. The state of the bath level rising after the commencement of actual pouring of the molten steel is shown by a broken line. A required time was detected at the confirmation level $L_y$, with the result that a difference of about 11 sec, was found to exist, from the required time $T_y$, due to the standard bath level rising pattern X and it was found that the bath level rising velocity was slower than the standard bath level rising velocity. Therefore, as shown by a dotted line, the bath level rising pattern was corrected, and in accordance with the correction of the opening degree of the sliding nozzle 6, was controlled to raise the steel level.

In the example, the steel level detecting device is able to detect a level above the confirmation level $L_y$. After the steel level a had reached the confirmation level $L_y$, and the corrected bath level rising pattern was set, the degree of opening of the sliding nozzle 6 was moment-to-moment controlled by the above-mentioned feedback control.

As a result, after substantially the same amount of time had passed, i.e., 52 secs, compared to the 50 sec of the predetermined holding time, the steel level reached the drawing commencement level $L_{21}$. Thus, drawing of the dummy bar 50 was commenced, and at the same time, a steel level control is carried out so that the early casting stage could be changed to usual operating state.

EXAMPLE 2

In a curved type continuous casting installation having a production capacity of 160 thousand ton per month, the present invention was applied while a low carbon aluminumkilled steel was produced.

The operating conditions and casting conditions of the present invention are shown in Table 2.

TABLE 2

| | | | |
|---|---|---|---|
| Operating conditions | Strand size | | Width 1000 mm × Thickness 250 mm |
| | Steel grade | | Low carbon aluminumkilled steel |
| | Shape of dummy bar head | | Shape shown in FIG. 9 |
| | Mold | Size | Length 900 mm<br>Plate thickness 60 mm |
| | | Material | Copper |
| | | Cooling conditions | Long side: 3000 l/mm<br>Short side; 600 l/mm |
| | Sliding nozzle diameter | | 70 mm |
| Casting conditions | Strand size | | The same as the above |
| | Molten steel depth in tundish | | 0.5–1.4 m |
| | Molten steel temperature | | 1550° C. ± 10° C. |

The holding time determined by a solidified shell formation velocity under the operating conditions given in Table 2 was 40 to 50 sec. Thus, in Example 2, a holding time $T_c$ was set to 50 sec and a drawing start level $L_{21}$ was 150 mm from the upper end of the mold. The confirmation level was set to 300 mm from the upper end of the mold, considering the above mentioned conditions. When a maximum flow rate was ensured by a sliding nozzle in Example 2, the bath level rising velocity became 42 mm/sec. Further, when only the rise of the steel level from the confirmation level $L_y$ to the commencement level $L_{21}$ is considered, the required time t of 4 to 5 sec was satisfactory. However, from past experience, the present invention knew that it is preferable to maintain the bath level rising velocity below 18 mm/sec, to enable a change to a level control as mentioned above. Therefore, at least 10 sec was needed for the required time t. Thus, after consideration of the required time, the required time $T_{yo}$ to reach the confirmation level $L_y$ was set to 26 sec, obtained through the standard bath level rising pattern X. In Example 2, when it was confirmed that the steel level a had not reached the confirmation level $L_y$ after the passage of 26 sec, an operating indication was immediately made to the flow rate control device 13, using the passage of the required time $T_{yo}$ (26 sec) as a trigger.

Figure 11A:
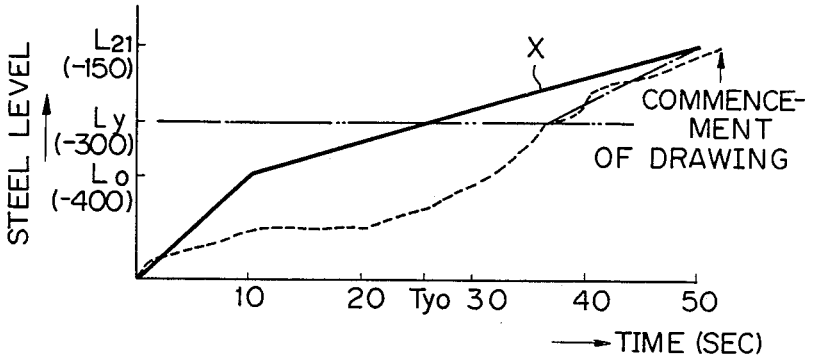
Figure 11B:
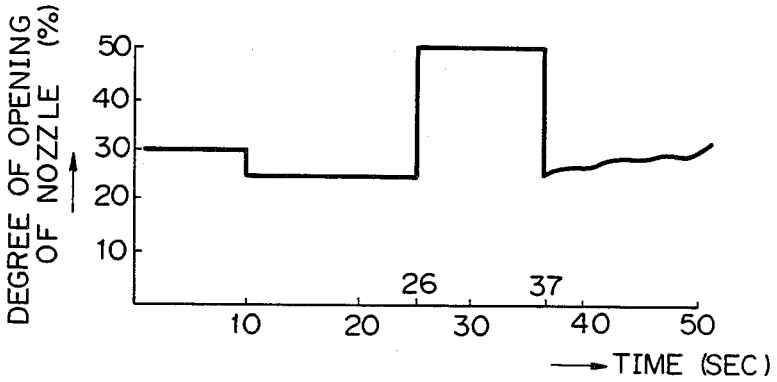

FIGS. 11A and 11B are diagrams illustrating the control states of Example 2. In particular, FIG. 11A shows a state of the steel level rise and FIG. 11B shows opening degrees of the sliding nozzle 6. The degree of opening of a sliding nozzle 6 at the early stage should be 30%, from past experience, whereby the $L_o$ is made 400 mm from the top end of the mold and the standard bath level rising pattern X was set to as shown by the solid line. The bath level rising state after the commencement of the pouring of molten steel is shown by a broken line. As can be seen from the shape of the broken line, as actual steel level a after the passage of the required time $T_{yo}$ (26 sec) was lower by 150 mm or more than the 300 mm of the confirmation level $L_y$. Thus, when the required time $T_{yo}$ had passed the degree of opening of the sliding nozzle 6 was changed from 25% to the 50% predetermined as an emergency treatment opening degree, so that the flow rate of the molten steel was increased resulting in a rise in the bath level rising velocity. This state was maintained for 11 sec, and as a result, the steel level a reached the confirmation level $L_y$ in good time. By carrying out such an emergency treatment, the time required for reaching the confirmation level $L_y$ can be controlled to be a time of about 11 sec longer than the required time $T_{yo}$ (26 sec) obtained from the standard bath level rising pattern X.

Therefore, when the steel level reached the confirmation level $L_y$ the actual bath level rising pattern was corrected so that the velocity thereof was higher than the standard bath level rising pattern X, as shown by a dotted line in FIG. 11A. Thus, the opening degree of the sliding nozzle 6 was controlled to raise the steel level, with the result that, after substantially the same amount of time (52 sec) as the 50 sec for the predetermined holding time had passed, the steel level reached the drawing commencement level $L_{21}$. Then drawing of the dummy bar 50 commenced, and at the same time, control was changed to the above-mentioned usual level control, whereby the first stage of the casting was smoothly changed to the usual operation state.

EXAMPLE 3

In a curved type continuous casting installation having a production capacity, of 160 thousand tons per month, the present invention was applied to the production of a low carbon aluminumkilled steel.

The operating conditions and casting conditions of the present inventions are shown in Table 3.

TABLE 3

| | | | |
|---|---|---|---|
| Operating conditions | Strand size | | Width 1000 mm × Thickness 250 mm |
| | Steel grade | | Low carbon aluminumkilled steel |
| | Shape of dummy bar head | | Shape shown in FIG. 6 |
| | Mold | Size | Length 900 mm Plate thickness 60 mm |
| | | Material | Copper |
| | | Cooling conditions | Long side: 3000 l/mm Short side; 600 l/mm |
| | Sliding nozzle diameter | | 70 mm |
| Casting conditions | Strand size | | The same as the above |
| | Molten steel depth in tundish | | 0.5–1.4 m |
| | Molten steel temperature | | 1550° C. ± 10° C. |

The holding time determined by a solidified shell formation velocity under the operating conditions shown in Table 3 was 40 to 50 secs. Thus, in Example 3, the holding time $T_c$ was set to 50 sec. and the drawing commencement level $L_{21}$ was set to 150 mm from the top end of the mold, and the confirmation level $L_y$ was set to a level 300 mm from the top end of the mold considering the above-mentioned conditions. In the present example, a sliding nozzle having a diameter of 70 mm was used as a flow rate control device. The emergency treatment opening degree was determined as 10%, due to the control properties of the sliding nozzle and the operating conditions.

Figure 12A:
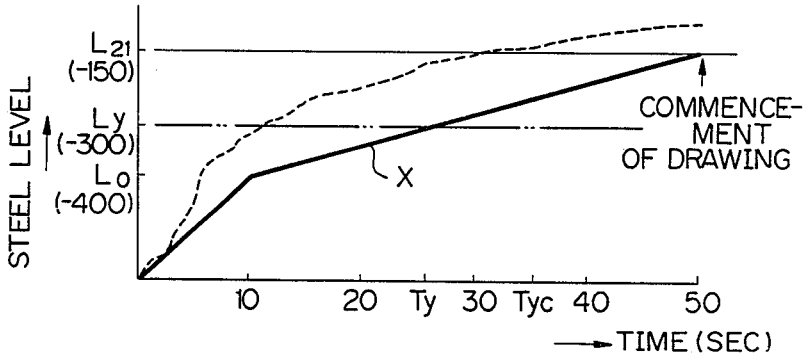
Figure 12B:
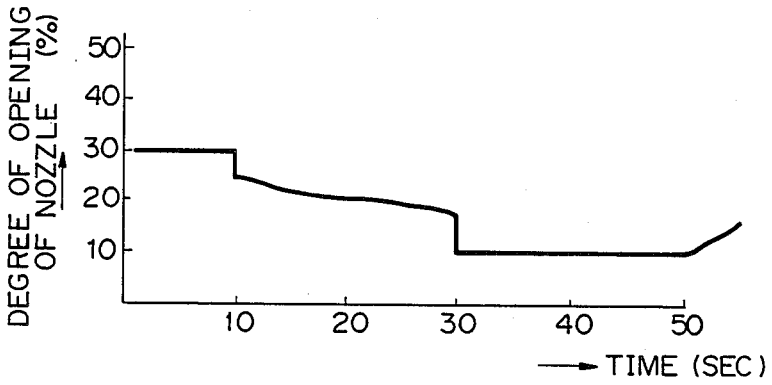

FIGS. 12A and 12B are diagrams illustrating the control states of Example 3. In particular, FIG. 11A shows a state of a steel level change and FIG. 11B shows the degree of opening of the sliding nozzle 6. The degree of opening of the sliding nozzle 6 at the early stage should be 30%, from past experience, whereby the $L_o$ is made to be 400 mm from the top end of the mold and the standard bath level rising pattern X was set as shown by a solid line. The bath level rising state after the commencement of pouring of the molten steel is shown by a broken line. As shown in FIG. 12A in Example 3, an actual bath level rising velocity was rapidly increased in the state where the first opening degree was maintained. Thus, the actual bath level rising pattern was corrected at the confirmation level $L_y$ so that the degree of opening of the sliding nozzle 6 was gradually reduced. However, the steel level a reached the drawing commencement level $L_{21}$ 18 sec. later than the holding time (50 sec.). Therefore, while using the reaching of the steel level a at the commencement level $L_{21}$ as a trigger, the opening degree of the sliding nozzle was immediately closed to the 10% emergency treatment opening degree, while maintaining a holding time (50 sec.), with the result that, when the steel level a reached a level higher by 50 mm than the drawing commencement level $L_{21}$, (150 mm from the top end of the mold) drawing could be commenced. This level was lower than an upper limit (Li in FIG. 1) of the usual level control and thus over flow of the molten steel from a mold was easily prevented. Thus the change to a level control was made without trouble.

As explained above, the required holding time was ensured and breakouts were completely prevented. In addition, nozzle clogging by maintaining an emergency treatment opening degree did not occur, and the usual operation was smoothly carried out.

We claim:

1. In an early stage of a continuous casting process comprising the steps of (a) commencing a pouring of molten steel into a mold provided with a dummy bar head through an immersion nozzle provided with a flow rate control device and determining a holding time for holding the molten steel in the mold through a solidified shell formation time in the mold under prevailing operating conditions before commencing a drawing of said dummy bar head and (b) after detecting that said steel level in the mold has reached a predetermined drawing commencement level, commencing to draw said dummy bar head, a method for controlling an early casting stage in a continuous casting process comprising the steps of:

(c) setting a standard steel bath level rising pattern so that said holding time for the molten steel in the mold corresponds to substantially the same elapsed time required for said steel level to reach said drawing commencement level, (d) predetermining at least one intermediate confirmation level lower than said drawing commencement level, (e) commencing pouring of the molten steel, (f) measuring the time elapsing after the commencement time of pouring and the time the steel bath level has reached at least said intermediate confirmation level, (g) carrying out flow rate control in accordance with the standard steel level rising pattern before said steel level reaches the predetermined intermediate confirmation level and calculating a deviation by comparing an actual time required with a time required in accordance with said standard steel bath level rising pattern, (h) carrying out flow rate control of the molten steel in accordance with a steel bath level rising pattern corrected so that deviations are corrected before said commencement of drawing, and commencing drawing of said dummy bar head after ensuring said holding time for the molten steel.

2. In an early stage of a continuous casting process comprising the steps of (a) commencing a pouring of molten steel into a mold provided with a dummy bar head through an immersion nozzle provided with a flow rate control device and determining a holding time for holding the molten steel in the mold through a solidified shell formation time in the mold under prevailing operating conditions before commencing a drawing of said dummy bar head and (b) after detecting that said steel level in the mold has reached a predetermined drawing commencement level, commencing to draw said dummy bar head, a method for controlling an early stage casting in a continuous casting process comprising the steps of:

(c) setting a standard steel bath level rising pattern so that said holding time for the molten steel in the mold corresponds to substantially the same elapsed time required for said steel level to reach said drawing commencement level, (d) predetermining at least one intermediate confirmation level lower than said drawing commencement level, (e) setting a time required for said steel level to reach said predetermined confirmation level in accordance with said standard steel bath level rising pattern by said operating conditions and casting conditions, (f) commencing the pouring of molten steel, (g) measuring a time elapsing after the commencement of pouring in accordance with the steel bath level rising pattern, (h) when the steel level after commencing pouring of the molten steel does not reach the intermediate level confirmation level in said required time, widening the opening degree of the flow rate control device to an opening degree needed for a predetermined emergency treatment to follow said standard steel bath level rising pattern, using the passage of said required time as a trigger.

3. In an early stage of a continuous casting process comprising the steps of:

(a) commencing a pouring of molten steel into a mold provided with a dummy bar head through an immersion nozzle provided with a flow rate control device and determining a holding time for holding the molten steel in the mold through a solidified shell formation time in the mold under prevailing operating conditions before commencing drawing of a dummy bar head and (b) after detecting that said steel level in the mold has reached a predetermined drawing commencement level, commencing to draw said dummy bar head, a method for controlling an early stage casting in a continuous casting process comprising the steps of:

(c) setting a standard steel bath level rising pattern so that said holding time for the molten steel in the mold corresponds to substantially the same elapsed time required for said steel level to reach said drawing commencement level, (d) commencing the pouring of the molten steel, (e) measuring a time elapsing after the commencement of pouring and in accordance with a steel bath level rising pattern, (f) detecting a time required from a commencement of pouring for said steel level to reach said drawing commencement level, (g) when the required time does not equal the molten steel holding time in said molten steel in the mold, reducing the degree of opening of the flow rate control device to an emergency treatment opening degree determined by prevailing control properties and the operating conditions using reaching of the steel level to said drawing commencement level, as a trigger, and commencing drawing after ensuring the holding time for the molten steel in a mold.

* * * * *